US005803806A

United States Patent [19]

Blessinger

[11] Patent Number: 5,803,806

[45] Date of Patent: Sep. 8, 1998

[54] APPARATUS AND METHOD FOR INSULATING ROOFRIDGE VENTILATOR SYSTEMS

[76] Inventor: James Blessinger, 21718 Ocean Pines Dr., Land O Lakes, Fla. 34639

[21] Appl. No.: 956,853

[22] Filed: Oct. 23, 1997

[51] Int. Cl.[6] ..... F24F 7/02

[52] U.S. Cl. ..... 454/365; 52/199

[58] Field of Search ..... 52/199; 454/364, 454/365, 366, 367, 368

[56] References Cited

U.S. PATENT DOCUMENTS

| | | | |
|---|---|---|---|
| 2,524,242 | 10/1950 | Weaver | 454/367 X |
| 4,000,688 | 1/1977 | Malott | 454/365 |
| 4,520,715 | 6/1985 | Coomes et al. | 454/367 |
| 5,706,618 | 1/1998 | Pratt | 454/365 X |

*Primary Examiner*—Harold Joyce
*Attorney, Agent, or Firm*—Dorothy Morse, American Innovations

[57] ABSTRACT

Materials and a method for attaching insulating material to roof ridge ventilators to prevent warm attic air from being exhausted through the louvered openings in such roof ridge ventilator systems during cool weather. At least two lengths of flexible molding material and a plurality of wire-like clamps. The wire-like clamps extend across the top of the roof ridge ventilator with each end being secured between the molding and the outer flashing portions of the roof ridge ventilator so as to secure the molding flush against vent openings in the underside surface of the roof ridge ventilator to completely block air flow therefrom.

4 Claims, 2 Drawing Sheets

APPARATUS AND METHOD FOR INSULATING ROOFRIDGE VENTILATOR SYSTEMS

BACKGROUND - FIELD OF INVENTION

This invention relates to insulating methods and materials for roof ventilating systems, specifically to materials and a method for attaching insulating material to roof ridge ventilators, such as the roof ridge ventilator system disclosed in U.S. Pat. No. 4,643,080 to Trostle (1987), to prevent warm attic air from being exhausted through the louvered openings in such roof ridge ventilator systems during cool weather.

BACKGROUND - DESCRIPTION OF PRIOR ART

It is known to have roof ridge ventilator systems to vent hot air from the space below a roof during warm weather. When soffit ventilators are also installed in the same building, air enters into the attic space of the building through the soffit ventilators and is then exhausted from the attic space through the roof ridge ventilator. The Trostle invention mentioned above discloses a ventilator having a top part, a pair of outer side panels downwardly and outwardly sloping from the top part in opposite directions, a louvered panel inwardly extending from the outer edge of each outer side panel with the inner edge of each louvered panel remaining spaced apart from the other to form a throat in communication with the open ridge of the building roof, and a flashing panel outwardly extending from the inner edge of each louvered panel to prevent blowing rain and snow from being blown through the louvers and into the space below the roof through the open roof ridge. The configuration of the Trostle invention creates a vent space on either of its sides between the louvered panel and its adjacent flashing panel through which the exhausted hot air flows away from the louvers and into the atmosphere. Although roof ridge ventilation systems are effective for exhausting hot air from spaces below a roof during warm weather, a disadvantage of roof ridge ventilator systems is that during cool weather they continue to exhaust hot air from attic spaces, thereby causing increased heating costs for the owners of the building to which they are attached. It is not known in this field to have apparatus and a method for attaching insulating material within the vent spaces of roof ridge ventilators, such as the roof ridge ventilator system disclosed in U.S. Pat. No. 4,643,080 to Trostle (1987), to prevent warm attic air from being exhausted through the louvered openings in such roof ridge ventilator systems during cool weather.

SUMMARY OF INVENTION - OBJECTS AND ADVANTAGES

It is the primary object of this invention to provide a means for preventing hot air from being exhausted through vent openings in a roof ridge ventilator system during cool weather. It is also an object of this invention to provide roof ridge ventilator system insulation apparatus which is easy to install and remove. A further object of this invention is to provide roof ridge ventilator system insulation apparatus which is simple in design, but effective in blocking roof ridge ventilator openings to prevent air flow therefrom. It is also an object of this invention to provide roof ridge ventilator system insulation apparatus which is made from relatively inexpensive materials. It is a further object of this invention to provide roof ridge ventilator system insulation apparatus which is made from materials which have a minimum useful life of approximately five years.

As described herein, properly manufactured and installed against the vent openings of a roof ridge ventilator, the present invention would provide an effective means of blocking the exhaust of hot air from such vent openings during cool weather. The present invention comprises multiple lengths of flexible molding and a plurality of flexible wire clamps. The molding is essentially wedge shaped for insertion between the louvered paneling and the protective flashing below each portion of louvered paneling in the roof ridge ventilator system. Wire clamps are positioned over the top part of the roof ridge ventilator and extend over the outer side panels with each end thereof positioned between the flexible molding and the protective flashing so as to bring the flexible molding tightly against the vent openings to block the exhaust of air therefrom.

The description herein provides preferred embodiments of the present invention but should not be construed as limiting the scope of the roof ridge ventilator system insulation apparatus invention. For example, variations in the material from which the flexible molding is made, the diameter of the wire-like material used, the type of wire-like material used, and the length of the sections of flexible molding used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
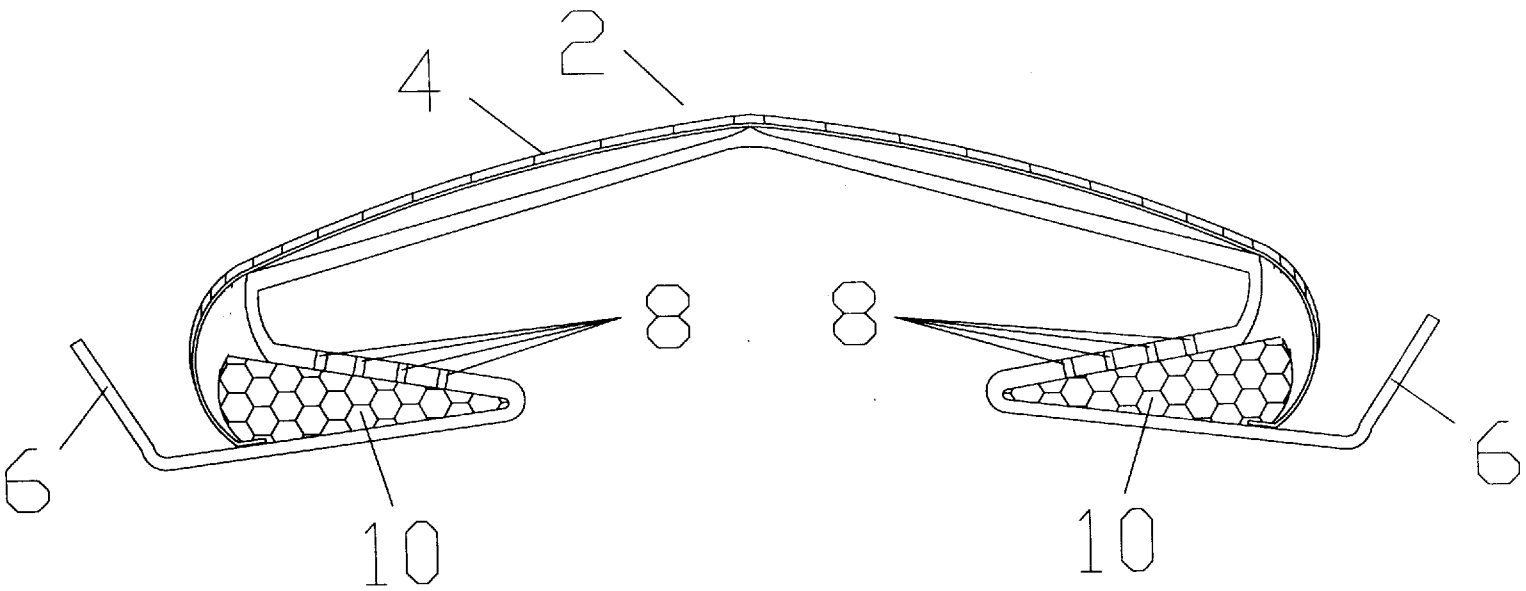
FIG. 1 is an end view of the invention attached to a roof ridge ventilator system.

FIG. 1 shows a preferred embodiment of a roof ridge ventilator system insulating apparatus 2 having a wire-like clamp 4 extending over the top of a roof ridge ventilator 6 and having each of its ends connected between the flashing portion of roof ridge ventilator 6 and a piece of molding 10 positioned to block air flow through vent openings 8 on the underside surface of roof ridge ventilator 6. Although the material from which wire-like clamps 4 are made is not critical to the present invention, in the preferred embodiment it is contemplated for wire-like clamps 4 to be made from flexible, non-corroding metallic wire which will not easily deteriorate upon continued exposure to weathering elements and solar radiation. Although FIG. 1 shows the length of wire-like clamp 4 to extend a short distance under the outer bottom portion of molding 10, the length of wire-like clamp 4 is not critical to the present invention and it is also contemplated that wire-like clamp 4 extend further under the bottom portion of molding 10. It is only critical that wire-like clamp 4 firmly hold molding 10 in place against vent openings 8. Also, the diameter of wire-like clamp 4 is not critical to the present invention, however, the diameter must allow wire-like clamp 4 to be flexible, bendable to conform to the configuration of the roof ridge ventilator to which it is attached, and be able to firmly hold molding 10 in place against vent openings 10 without sagging or disruption by weathering forces. Also, the material from which molding 10 is made, and the length of each section of molding 10 used, are not critical to the present invention. However, in the preferred embodiment molding 10 must be made from a flexible material, such as a plastic or foam material, to permit it to conform to the configuration of roof ridge ventilator 6 so as to become positioned flush against vent openings 8 to block air flow therethrough when secured into position by wire-like clamps 4. Also, in the preferred embodiment, sections of molding 10 having a length dimension of approximately five feet for ease in handling them. Further, although not critical, in the preferred embodiment it is contemplated for the wedge shape of molding 10 to have a base dimension of less than one inch, with each side dimension having a length less than two inches.

Figure 2:
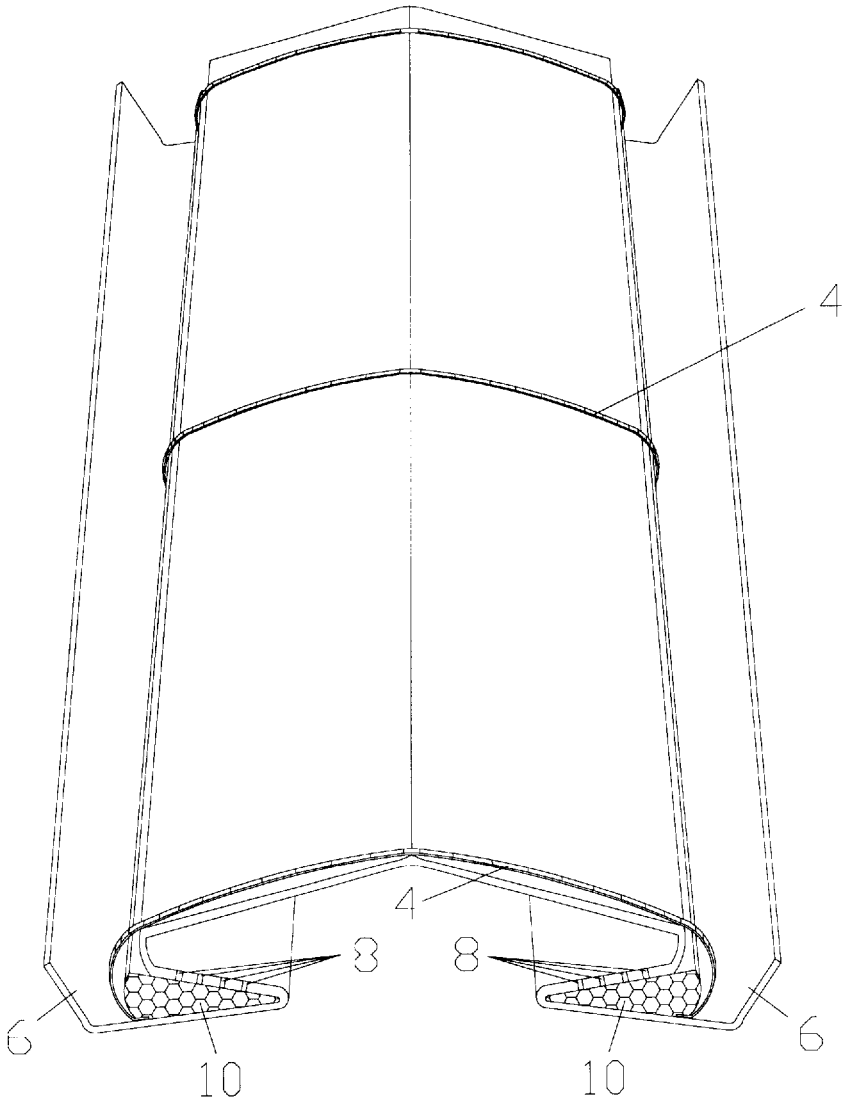
FIG. 2 is a perspective view of the invention attached to a roof ridge ventilator system.

FIG. 2 shows several wire-like clamps 4 attaching molding 10 to roof ridge ventilator 6 so that molding 10 is flush against vent openings 8 so as to completely block air flow through vent openings 8. Although the number of wire-like clamps 4 is not critical to the present invention, in the preferred embodiment it is contemplated to have four to six wire-like clamps 4 securely attaching a five foot section of molding 10 against vent openings 8 in roof ridge ventilator 6. In the preferred embodiment it is also contemplate d for the materials use d for wire-like clamps 4 and molding 10 to have sufficient durability to withstand the deteriorating influence of weathering forces for a minimum period of approximately five years.

What is claimed is:

1. Insulation apparatus for a roof ridge ventilation system having a plurality of vent openings on its underside surfaces and protective flashing depending downwardly and outwardly from each of said underside surfaces to prevent rain and snow from blowing into said vent openings, said insulation apparatus comprising at least two lengths of molding and a plurality of elongated wire-like clamps, each of said wire-like clamps having opposite ends, each of said lengths of molding having a bottom surface and being made from flexible material having a configuration conformable to a vent space for exhausting hot air which exists between each of said underside surfaces of said roof ridge ventilator and said protective flashing which is adjacent thereto so that when placed into each of said vent spaces said lengths of molding completely block said vent openings in said roof ridge ventilator, each of said wire-like clamps being made from a flexible material and positioned over said roof ridge ventilator and extending around one of said lengths of molding so that each of said opposite ends of said wire-like clamp is positioned between said bottom surface of said molding and said protective flashing to tightly position said molding against said vent openings and prevent air flow therefrom.

2. The insulation apparatus of claim 1 wherein each of said lengths of molding has a length dimension of approximately five feet for ease in handling thereof.

3. The insulation apparatus of claim 1 wherein each of said lengths of molding and each of said wire-like clamps is made from materials which are able to withstand deteriorating effects of weathering forces and solar radiation for a minimum period of approximately five years.

4. A method for insulating roof ridge ventilators by blocking air flow through vent openings on the underside surface of the roof ridge ventilator, said method comprising the steps of providing at least two lengths of flexible molding and a plurality of flexible wire-like clamps; placing each of said lengths of molding within a vent space formed between said underside surface of said roof ridge ventilator and flashing attached to said roof ridge ventilator so that each of said lengths of molding is positioned flush against said vent openings; placing each of said wire-like clamps over the top of said roof ridge; extending ends of each of said wire-like clamps around one of said lengths of molding; and placing said ends of each of said wire-like clamps between one of said lengths of molding and said flashing so as to thereby secure said lengths of molding against said vent openings to block air flow therefrom.

* * * * *